US005131616A

United States Patent [19]

Biba

[11] Patent Number: 5,131,616

[45] Date of Patent: Jul. 21, 1992

[54] BRACKET FOR ADJUSTABLY SUPPORTING A HEADRAIL

[75] Inventor: Scott I. Biba, Mazomanie, Wis.

[73] Assignee: Graber Industries, Inc., Middleton, Wis.

[21] Appl. No.: 711,878

[22] Filed: Jun. 7, 1991

Related U.S. Application Data

[63] Continuation-in-part of Ser. No. 600,828, Oct. 22, 1990, abandoned.

[51] Int. Cl.[5] ..... A47H 1/10

[52] U.S. Cl. ..... 248/265; 248/298; 160/902

[58] Field of Search ..... 248/265, 267, 269, 271, 248/259, 227, 256, 258, 307, 316.4, 208, 231.4, 297.2, 295.1, 298; 160/902

[56] References Cited

U.S. PATENT DOCUMENTS

| | | | |
|---|---|---|---|
| 2,371,903 | 3/1945 | Maier . | |
| 2,976,005 | 3/1961 | Stell | 248/298 |
| 3,029,465 | 4/1962 | Graber et al. | 248/298 X |
| 3,030,060 | 4/1962 | Breuer | 248/316.4 X |
| 3,889,439 | 6/1975 | Kaspar . | |
| 4,120,474 | 10/1978 | Hurley . | |
| 4,179,091 | 12/1979 | Bidney | 248/295.1 X |
| 4,363,459 | 12/1982 | Holzer . | |
| 4,436,269 | 3/1984 | Dirksing et al. | 248/297.2 X |
| 5,044,589 | 9/1991 | Milne et al. | 160/902 X |

*Primary Examiner*—Carl D. Friedman
*Assistant Examiner*—Korie H. Chan
*Attorney, Agent, or Firm*—Vernon J. Pillote

[57] ABSTRACT

A bracket assembly for adjustably supporting a headrail of a window covering. The bracket assembly includes a wall bracket having a generally horizontal bracket arm and a unitary slide body slidably mounted on the arm and having an upper portion that overlies the bracket arm and at least one lower cross portion that underlies the arm. A headrail support clip device has an intermediate portion that overlies the lower cross portion of the slide body for support thereon and front and rear leg portions that extend downwardly from the intermediate portion for supportably engaging a headrail below the lower cross portion of the slide body. The slide body is adjustable along the arm to positions in which the arm closely overlies and retains the clip device on the lower cross portion of the slide body. Mechanism is provided on the slide body engageable with the arm for releasably retaining the slide body in different adjusted positions along the arm.

17 Claims, 2 Drawing Sheets

Fig. 1.
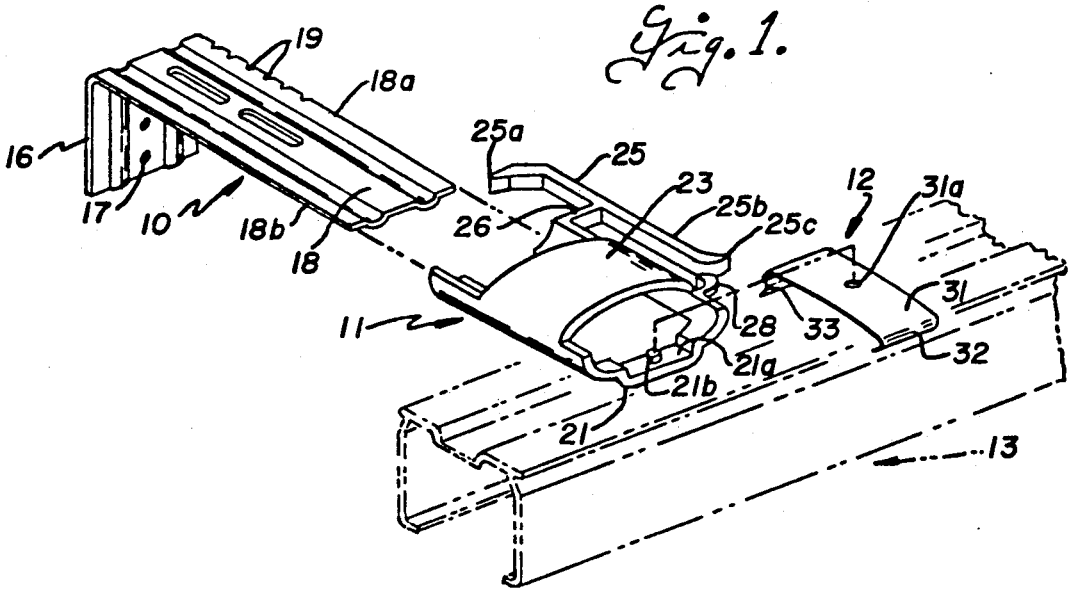
Fig. 5.
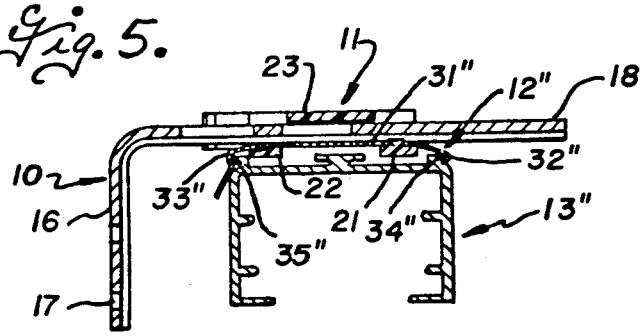
Fig. 4.
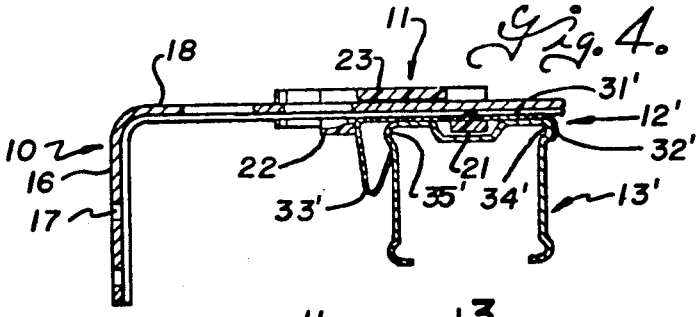
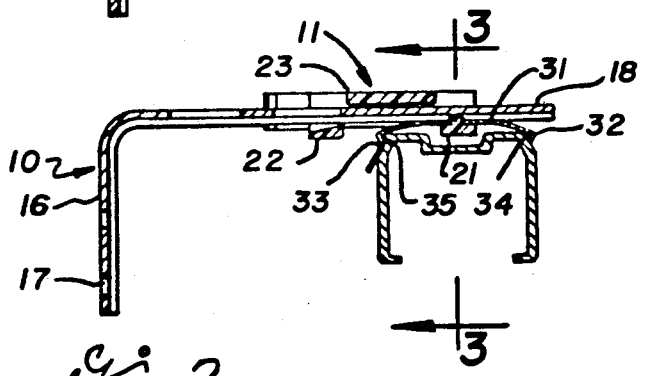
Fig. 2.
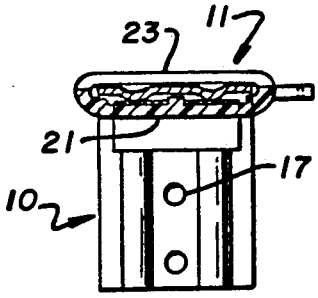
Fig. 3.

Fig. 6.
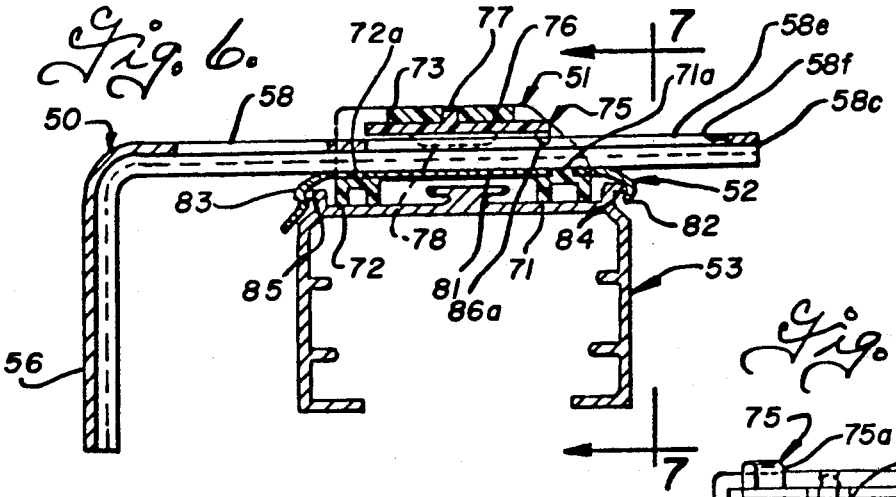
Fig. 7.
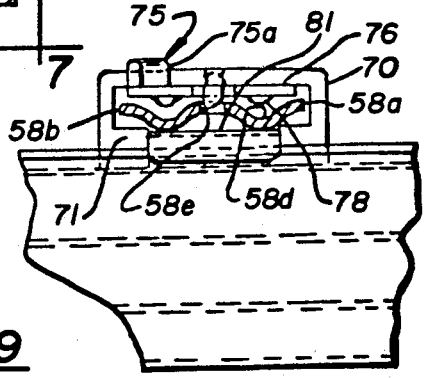
Fig. 8.
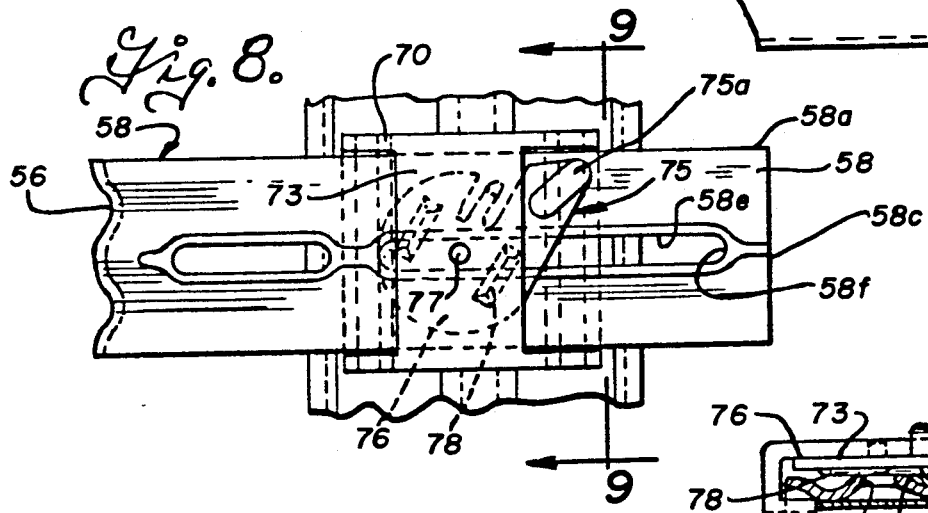
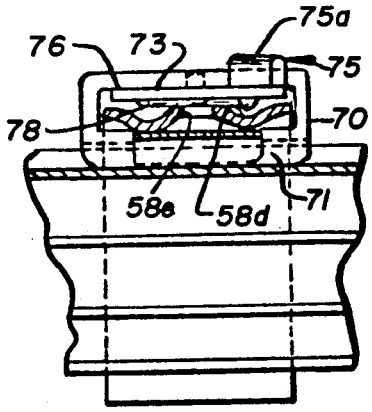
Fig. 9.
Fig. 10.
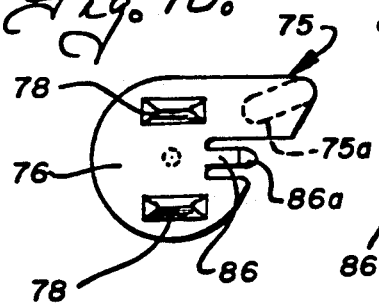
Fig. 11.
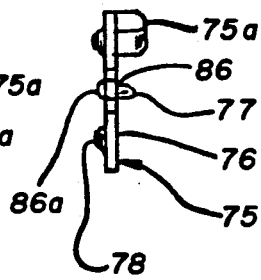

BRACKET FOR ADJUSTABLY SUPPORTING A HEADRAIL

CROSS-REFERENCE TO RELATED APPLICATION

This application is a continuation-in-part of my copending application Ser. No. 07/600,828, filed Oct. 22, 1990, now abandoned. "Bracket For Adjustably Supporting A Headrail".

BACKGROUND OF THE INVENTION

It is common practice to mount headrails for various window coverings using a spring clip device having an intermediate portion adapted to overlie the headrail and front and rear leg portions that extend downwardly from the intermediate portion for supportably engaging a head rail. In ceiling mount installations, the intermediate portion of the clip device is fastened by a screw or the like directly to the overhead support. In wall mount installations, the intermediate portion of the clip device is fastened by a screw, bolt or rivet either directly to the horizontal leg of a wall bracket or to a slidable extension of the wall bracket, for example as shown in U.S. Pat. No. 4,363,459. In order to adjust the spacing of the headrail from the wall or other vertical mounting surfaces, it is generally necessary to remove or at least loosen the fastener that attaches the clip to the wall bracket to enable adjustment of the clip relative to the upright support surface. However, the fastener that attaches the spring clip to the wall bracket is not readily accessible when the headrail is installed on the spring clip.

SUMMARY OF THE INVENTION

It is on object of the present invention to provide a bracket assembly which reduces the number of separate parts which must be formed and assembled and which does not require the use of tools to assemble the headrail on a wall bracket.

Another object of this invention is to provide a bracket assembly for adjustably supporting a headrail of a window covering, and which can be easily adjusted without the use of tools toward and away from the wall, while the headrail is mounted on the bracket assembly.

Accordingly, the present invention provides a bracket assembly for adjustably supporting a headrail of window covering comprising a wall bracket having a generally horizontal bracket arm and a unitary slide body slidably mounted on the arm and having an upper portion that overlies the arm and at least one lower cross portion that underlies the arm. A clip device having an intermediate portion overlies and is supported on the lower cross portion of the slide member and has front and rear leg portions extending downwardly from the intermediate portion for supportably engaging a headrail below the cross portion. The slide body is adjustable along the arm to positions in which the arm overlies the clip device to retain the clip device on the lower cross portion of the slide body.

Means are provided on the slide body for engaging the arm to releasably retain the slide body in different adjusted positions along the bracket arm. In accordance with one embodiment, a latch member is integrally joined by a flexible section to the slide body for pivotal movement in a generally horizontal plane and the latch member has a nose adjacent one end thereof engagable with the detent means on the arm for retaining the slide body in different adjusted positions along the arm. The latch member is manually movable to a release position in which the nose disengages the detent means on the arm and means are provided on the slide body for releasably retaining the latch member in its release position.

In a presently preferred embodiment, a cam member is interposed between an upper side of the bracket member and the upper portion of the slide body. The cam member is selectively movable between a release position in which it is loosely disposed between the arm and the slide body and a clamp position in which it is wedged between the bracket arm and the slide body. The cam member is preferably mounted on the upper portion of the slide body for angular movement between the release and clamp positions.

BRIEF DESCRIPTION OF THE DRAWINGS

FIG. 1 is an exploded isometric view of the bracket assembly;

FIG. 2 is a vertical sectional view through the bracket assembly illustrating the bracket assembly with one type of spring device for use with one style and size of headrail;

FIG. 3 is a transverse sectional view taken on the plane 3—3 of FIG. 2, and illustrating parts on a larger scale than FIG 2;

FIG. 4 is a vertical sectional view through the bracket assembly illustrating the bracket assembly with a second style /spring clip for use with a different size and style headrail;

FIG. 5 is a vertical sectional view through the bracket assembly illustrating the bracket assembly with a third type of spring clip for still another form and size of headrail;

FIG. 6 is a vertical sectional view through the bracket assembly with a headrail supported thereon;

FIG. 7 is a transverse sectional view taken on the plane 7—7 of FIG. 6;

FIG. 8 is a top plan view of the bracket assembly;

FIG. 9 is a transverse sectional view taken on the plane 9—9 of FIG. 8;

FIG. 10 is a bottom view of a clamp device for clamping the slid to the bracket arm; and FIG. 11 is a front view of the clamp device taken on the plane 11—11 of FIG. 10.

DETAILED DESCRIPTION

Referring first to the embodiment of FIGS. 1-5, the bracket assembly in general includes a wall bracket 10, a slide body 11, and a headrail mounting clip 12 for supporting a headrail 13, of a window covering, for example the headrail of a vertical blind.

The wall bracket 10 is a generally L-shaped configuration and includes a generally upright leg or pad 16 having fastener receiving openings 17 for attaching the wall bracket to an upright support surface such as a wall, and a generally horizontal arm 18 that extends forwardly from the leg portion 16. The arm has relatively parallel side edges **18*a*, 18*b* (FIG. 1) and a plurality of notches or detents 19 are provided in at least one of the side edges 18*a***.

The slide body is slidably mounted on the arm 18 for adjustment therealong and includes at least one and preferably two lower cross portions 21 and 22 that are adapted to underlie the arm 18. The slide body also includes an upper cross portion 23 adapted to overlie the arm. The slide body is preferably molded in one piece of a synthetic resin material that is relatively rigid in thick sections and sufficiently resilient to allow limited flexing in thin sections, for example medium impact ABS. As best shown in FIG. 1, an elongated latch member 25 is formed integrally with the slide body and is integrally joined intermediate its ends to the slide body by flexible section 26, arranged to allow limited pivotal movement of the latch member in a generally horizontal plane relative to the slide body. The latch member 25 has a nose portion 25*a* on one end engageable with the notches or detents 19 in the arm to releasably retain the slide body in different adjusted positions along the arm. The latch member has a portion 25*b* at the end remote from the nose 25*a* and which can be depressed by a finger of the user toward the slide body to move the latch member to a release position in which the nose 25*a* disengages the detents. As will be readily understood, two or more bracket assemblies are required to support a headrail and, in order to facilitate adjustment of the headrail along its entire length, a catch 28 is provided on the slide body and arranged to engage an end 25*c* on the latch member to releasably retain the latch member in its release position. Thus, the portion 25*b* of the latch member can be depressed toward the slide body to a position in which the end 25*c* is engaged by the latch 28 to enable free adjustment of the slide body along the arm. The catch 28 is joined to the slide body with a thin resilient section so that the catch 28 can be manually pressed out of engagement with end 25*c*, to allow the latch member to move back into its detent engaging position.

The clip device 12 is preferably formed of spring steel and includes an intermediate portion 31 and front and leg portions 32 and 33. In general, the intermediate portion 31 is adapted to overlie and span the width of a headrail 13, and the front and rear leg portions 32 and 33 are arranged to engage forward and rear ribs 34, 35 on the headrail to support the headrail. The intermediate portion 31 of the clip device is positioned to overlie the lower cross portion 21 of the slide for support thereon. As best shown in FIG. 1, the lower cross portion 21 has a depressed area 21*a* for receiving the intermediate portion on the clip device and a prong 21*b* extends upwardly from the cross portion and into an aperture 31*a* in the intermediate portion of the clip device to locate the clip device on the cross member. As best shown in FIGS. 2-5, the slide body is adjustable along the arm to positions in which the arm closely overlies the clip device 12, to retain the clip device on the cross portion of the slide body.

In the modified clip device 12' shown in FIG. 4 for supporting a modified headrail 13', the clip device has forward and rear legs 32' and 33' arranged to supportably engage ribs 34' and 35' on the headrail 13'. In this embodiment, the intermediate portion 31' of the clip device 12' engages a forward face on the rear lower cross member 22.

In the embodiment of FIG. 5, the headrail 13" is somewhat wider than in the embodiments of FIGS. 2 and 4 and the intermediate portion 31" of the clip device 12" overlies both the front and rear or cross portions 21 and 22 of the slide body. Front and rear leg portions 32", 33" extend downwardly below the lower cross portions on the slide body and engage ribs 34", 35" on the headrail.

Reference is now made to the presently preferred embodiment illustrated in FIGS. 6-11. As in the preceding embodiment, the bracket assembly includes a wall bracket 50, a slide body 51 and a headrail mounting clip 52 for supporting a headrail 53 of a window covering, for example the headrail of a vertical blind. The wall bracket 50 has a generally L-shaped configuration and includes a generally upright leg or pad 56 having fastener receiving openings for attaching the wall bracket to an upright support surface such as a wall, and a generally horizontal arm 58 that extends forwardly from the leg portion 56. The bracket arm 58 has relatively parallel side edges 58*a* and 58*b* (FIGS. 7-9), and a forward end 58*c*. The bracket arm also has lengthwise extending depressions 58*d* and lengthwise extending slots 58*e* that terminate inwardly of the forward end 58*c* to form a rearwardly facing abutment 58*f*. The slide body 51 is movable along the bracket arm and has parallel side portions 70, front and rear lower cross portions 71 and 72 that extend between the side portions and underlie the arm, and an upper portion 73 that extends between the side portions and overlies the bracket arm. The slide body is conveniently molded in one piece of a synthetic resin material such as high impact ABS.

The clip device 52 includes an intermediate portion 81 that is adapted to overlie and span the width of the headrail 53, and front and rear leg portions 82 and 83 arranged to engage forward and rear ribs 84 and 85 on the headrail to support the headrail. As described in connection with the embodiments of FIGS. 1-5, the intermediate portion of the clip device is constructed and arrange to overlie at least one of the lower cross portions for support thereon. Thus, clip devices such as shown at 31 and 31' in FIGS. 2 and 4, respectively can overlie the forward cross portion 71. The clip device 81 illustrated in the embodiments of FIGS. 6-11 is similar to the clip device shown at 31" in FIG. 5 and the intermediate portion of the clip device is arranged to overlie both the front and rear lower cross portions 71 and 72. Provision is made for laterally positioning the clip device on the lower cross portions and as shown in FIG. 6, the intermediate portion 81 of the clip device has openings for receiving upwardly extending prongs 71*a* and 72*a* on the forward and rear cross portions respectively.

A clamp device is mounted on the slide body and is engageable with the bracket arm for releasably retaining the slide body in different adjusted positions along the bracket arm. In this embodiment, the clamp device includes a lever 75 conveniently formed of synthetic resin material such as ABS. The lever includes a handle 75*a* and a cam portion 76 loosely disposed between the upper side of the bracket arm 58 and the underside of the upper portion 73 of the slide body. The lever is mounted on the upper cross portion for pivotal movement relative thereto by generally upright axis and, as best shown in FIGS. 6 and 8, the cam portion has an integral pintle 77 that is rotatably received in an opening in the upper cross portion. Cam lobes 78 are formed on the underside of the cam portion 76 and are arranged to be received in the depressions 58*d* in the bracket arm, when the lever is in a release position as shown in FIGS. 6 and 7. The slide body can be adjusted along the bracket arm when the lever is in its release position. When the slide body is adjusted along the bracket arm to the desired position, the cam lever can be turned about the pintle 77 to move the cam lobes 78 crosswise of the ridge between the depressions 58*d* in the bracket arm, to a clamp position in which the cam portion of the lever is wedged between the upper side of the bracket arm and the upper side of the slide body to clamp the slide body against movement along the bracket arm. Thus, when the cam lever is in its clamp position, the slide body is cammed upwardly relative to the bracket arm to draw the lower cross portions 71 and 72 and the intermediate portion 81 of the clip 52 against the underside of the bracket arm.

Provision is also made for preventing accidental detachment of the slide body from the bracket arm after it has been mounted thereon. A resilient finger 86 is conveniently formed integrally with the cam portion of the lever and has a nose 86*a* arranged to extend into the slot 58*e* in the bracket arm when the lever is in the release position as shown in FIGS. 6 and 7. The nose 86*a* on the resilient finger is adapted to engage the rearwardly facing abutment face 58*f* at the forward end of the slot 58*e* to prevent accidental movement of the slide body off the forward end of the bracket arm and the sides of the nose 86*a* are beveled or rounded to cam out of the slot when the lever is turned out of its release position.

From the foregoing it will be seen that the headrail support device 12 can be mounted on the slide body without the use of separate fasteners or tools and that the clip device is retained in position on the slide body by the arm of the wall bracket. Further, the slide body with the clip device is supported thereon, is adjustable along the arm of the wall bracket without the use of tools and can be selectively locked in adjusted position.

The embodiments of the invention in which an exclusive property or privilege is claimed are defined as follows:

1. A bracket assembly for adjustably supporting a headrail of a window covering comprising, a wall bracket including an elongated generally horizontal bracket arm having a forward end, a unitary slide body movable along the arm and having an upper portion adapted to overlie the arm and at least one lower cross portion adapted to underlie the arm, a clip device having an intermediate portion overlying said lower cross portion of the slide body for support thereon and front and rear leg portions extending downwardly from the intermediate portion of the clip device at locations respectively forwardly and rearwardly of said one lower cross portion of the slide body for supportably engaging the headrail below the cross portion, the slide body being slidable onto the forward end of the arm to positions in which the arm closely overlies the intermediate body portion of the clip device to retain the clip device on the lower cross portion of the slide body.

2. A bracket assembly according to claim 1 wherein said lower cross portion has a prong extending upwardly therefrom, the clip device having an opening in the intermediate portion for receiving said prong.

3. A bracket assembly according to claim 1 including means mounted on the slide body and engageable with the bracket arm for releasably retaining the slide body in different adjusted positions along the bracket arm.

4. A bracket assembly according to claim 1 including a lever mounted on the slide body for angular movement relative thereto between release and lock positions, and means on the lever for engaging the bracket arm, when the lever is in the lock position thereof, to retain the slide body against movement along the bracket arm and for disengaging the bracket arm when the lever is in the release position thereof to allow movement of the slide body along bracket arm.

5. A bracket assembly according to claim 1 including a cam member interposed between an upper side of the bracket arm and the upper portion of the slide body, means mounting the cam member on the upper portion of the slide body for movement relative thereto between a release position in which the cam member is loosely disposed between the upper side of the bracket arm and the upper portion of the slide body and a clamp position in which the cam member is wedged between the upper side of the bracket arm and upper portion of the slide body to clamp the slide body against movement along the bracket arm.

6. A bracket assembly according to claim 1 including a lever having a cam portion interposed between an upper side of the bracket arm and the upper portion of the slide body, means mounting the lever on the upper portion of the slide body for angular movement relative thereto between a release position in which the cam portion is loosely disposed between the upper side of the bracket arm and the upper portion of the slide body and a clamp position in which cam portion is wedged between upper side of the bracket arm and the upper portion of the slide body to clamp the slide body against movement along the bracket arm.

7. A bracket assembly according to claim 6 wherein the upper side of the bracket arm has at least one depression extending lengthwise of the bracket arm, the cam section having cam lobe disposed in said depression when the lever is in the release position thereof.

8. A bracket assembly according to claim 6 wherein the bracket arm has a longitudinally extending slot therein spaced from the forward end of the bracket arm to define a rearwardly facing abutment, the lever having resilient detent means thereon constructed and arranged to extend into the slot when the lever is in the release position for engagement with the rearwardly facing abutment to prevent accidental movement of the slide body off the forward end of the bracket arm.

9. A bracket assembly according to claim 1 wherein the slide body is formed of synthetic resin material, detent means on the arm, and a latch finger integral with said slide body and engageable with the detent means for releasably retaining the slide body in different adjusted positions along the arm.

10. A bracket assembly according to claim 1 wherein the arm has parallel side edges disposed in a generally horizontal plane and detent means on at least one of the side edges, the slide body being formed of synthetic resin material, and a latch member integrally joined by a flexible section to the slide body for pivotal movement in a generally horizontal plane, the latch member having a nose adjacent one end thereof engageable with the detent means on the arm for releasably retaining the slide body in different adjusted positions along the arm.

11. A bracket assembly according to claim 1 wherein the arm has parallel side edges disposed in a generally horizontal plane and detent means on at least one of the side edges, the slide body being formed of synthetic resin material, an elongated latch member integrally joined intermediate its ends by a flexible section to the slide body for pivotal movement in a generally horizontal plane, the latch member having a nose adjacent one end thereof engageable with the detent means on the arm for retaining the slide body in different adjusted positions along the arm, the latch member being manually movable to a release position in which the nose disengages the detent means.

12. A bracket according to claim 11 including means on the slide body for releasably retaining said latch member in said release position.

13. A bracket assembly for adjustably supporting a headrail of a window covering comprising. a wall bracket including an elongated generally horizontal bracket arm having parallel side edges and a forward end, a unitary slide body moveable along the arm and having parallel side portions, an upper portion extending between the side portions and adapted to overlie the bracket arm and spaced front and rear lower cross portions extending between the side portions and adapted to underlie the arm, a clip device having an intermediate portion overlying at least one of the lower cross portions of the slide body for support thereon and front and rear leg portions extending downwardly from the intermediate portion respectively forwardly and rearwardly of said one lower cross portion for supportably engaging the headrail below the cross portion, the slide body being slidable onto the forward end of the arm to positions in which the arm closely overlies the clip device to retain the clip device on said one lower cross portion of the slide body.

14. A bracket assembly according to claim 13 wherein the intermediate portion of the clip device overlies both the front and rear lower cross portions of the slide body.

15. A bracket assembly according to claim 13 wherein one of said lower cross portions has a prong extending upwardly therefrom, the clip device having an opening in the intermediate portion for receiving said prong.

16. A bracket assembly according to claim 13 including a lever having a cam portion interposed between an upper side of the bracket arm and the upper portion of the slide body, means mounting the lever on the upper portion of the slide body for angular movement relative thereto between a release position in which the cam portion is loosely disposed between the upper side of the bracket arm and the upper portion of the slide body and a clamp position in which cam portion is wedged between upper side of the bracket arm and the upper portion of the slide body to clamp the slide body against movement along the bracket arm.

17. A bracket assembly according to claim 16 wherein the upper side of the bracket arm has at least one depression extending lengthwise of the bracket arm, the cam section having a cam lobe disposed in said depression when the lever is in the release position thereof.

* * * * *